US011333144B2

(12) United States Patent
Goto

(10) Patent No.: US 11,333,144 B2
(45) Date of Patent: May 17, 2022

(54) PIEZOELECTRIC PUMP AND LIQUID EJECTION DEVICE

(71) Applicant: TOSHIBA TEC KABUSHIKI KAISHA, Tokyo (JP)

(72) Inventor: Taiki Goto, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 132 days.

(21) Appl. No.: 16/685,511

(22) Filed: Nov. 15, 2019

(65) Prior Publication Data

US 2020/0263678 A1 Aug. 20, 2020

(30) Foreign Application Priority Data

Feb. 20, 2019 (JP) ..... JP2019-028314

(51) Int. Cl.

| | |
|---|---|
| ***F04B 43/04*** | (2006.01) |
| ***B41J 2/12*** | (2006.01) |
| ***F04B 53/16*** | (2006.01) |
| ***F04B 17/00*** | (2006.01) |
| ***B41J 2/14*** | (2006.01) |

(52) U.S. Cl.

CPC ..... *F04B 43/04* (2013.01); *B41J 2/14* (2013.01); *F04B 17/003* (2013.01); *F04B 43/046* (2013.01); *F04B 53/16* (2013.01)

(58) Field of Classification Search

CPC ..... F04B 43/04; F04B 43/043; F04B 43/046; F04B 17/003; F04B 53/16; F04B 23/02; B41J 2/14

See application file for complete search history.

(56) References Cited

U.S. PATENT DOCUMENTS

| | | | | |
|---|---|---|---|---|
| 8,523,538 | B2 | 9/2013 | Kawamura et al. | |
| 9,611,843 | B2 | 4/2017 | Hsueh et al. | |
| 2007/0065309 | A1* | 3/2007 | Nakajima | F04B 43/046 417/413.1 |
| 2008/0095651 | A1* | 4/2008 | Onishi | F04B 43/046 417/558 |
| 2009/0060762 | A1* | 3/2009 | Ishikawa | F04B 43/046 417/413.2 |
| 2012/0301333 | A1 | 11/2012 | Smirnov | |
| 2014/0010735 | A1* | 1/2014 | Tanaka | F04B 43/046 422/504 |

(Continued)

FOREIGN PATENT DOCUMENTS

| | | |
|---|---|---|
| CN | 102165193 A | 8/2011 |
| CN | 104019018 A | 9/2014 |

(Continued)

OTHER PUBLICATIONS

Chinese Office Action dated Aug. 23, 2021, mailed in counterpart Chinese Application No. 201911328741.1, 19 pages (with translation).

*Primary Examiner* — Charles G Freay
(74) *Attorney, Agent, or Firm* — Kim & Stewart LLP

(57) ABSTRACT

According to an embodiment, a piezoelectric pump includes a pressure chamber. A groove is provided to a bottom portion of the pressure chamber. The groove includes an inlet and an outlet on a bottom portion of the groove, liquid being caused to flow in the pressure chamber through the inlet and to be discharged from the pressure chamber through the outlet.

20 Claims, 9 Drawing Sheets

(56) References Cited

U.S. PATENT DOCUMENTS

| | | | | |
|---|---|---|---|---|
| 2016/0159102 | A1 | 6/2016 | Kaneko | |
| 2018/0333955 | A1* | 11/2018 | Oikawa | B41J 2/04541 |

FOREIGN PATENT DOCUMENTS

| | | | |
|---|---|---|---|
| CN | 107364234 | A | 11/2017 |
| JP | 2008163902 | A | 7/2008 |
| JP | 5003154 | B2 | 8/2012 |
| KR | 20120131857 | A | 12/2012 |
| TW | 201500151 | A | 1/2015 |

* cited by examiner

PIEZOELECTRIC PUMP AND LIQUID EJECTION DEVICE

CROSS-REFERENCE TO RELATED APPLICATIONS

This application is based upon and claims the benefit of priority from the prior Japanese Patent Application No. 2019-028314, filed on Feb. 20, 2019, the entire contents of which are incorporated herein by reference.

FIELD

An embodiment to be described here generally relates to a piezoelectric pump and a liquid ejection device.

BACKGROUND

For example, there is known a technique of using a piezoelectric pump in a liquid ejection device, the liquid ejection device being used in a recording apparatus of a ink circulating system including an inkjet head, or other apparatuses. The piezoelectric pump changes the volume of a pressure chamber by causing a bending displacement of a diaphragm, suctions liquid from an inlet, and then ejects the liquid from an outlet.

If the liquid contains air bubbles, the air bubbles are possibly accumulated in the pressure chamber. In this regard, there is a demand for a piezoelectric pump capable of suitably discharging air bubbles of a pressure chamber.

DETAILED DESCRIPTION

According to one embodiment, a piezoelectric pump includes a pressure chamber, a diaphragm, a groove, a first check valve, and a second check valve. The pressure chamber has a variable volume. The diaphragm varies the volume of the pressure chamber by deforming. The groove is provided to a bottom portion of the pressure chamber and includes an inlet and an outlet on a bottom portion of the groove, liquid being caused to flow in the pressure chamber through the inlet and to be discharged from the pressure chamber through the outlet. The first check valve is provided to the inlet and regulates a flow of the liquid. The second check valve is provided to the outlet and regulates the flow of the liquid.

Figure 1:
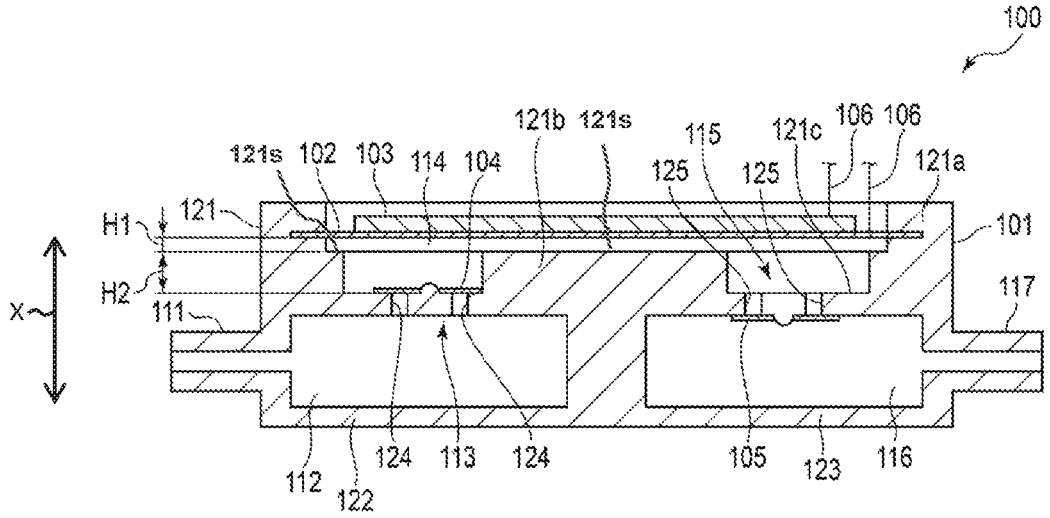
FIG. 1 is a cross-sectional view of a configuration of a piezoelectric pump according to an embodiment.
Figure 2:
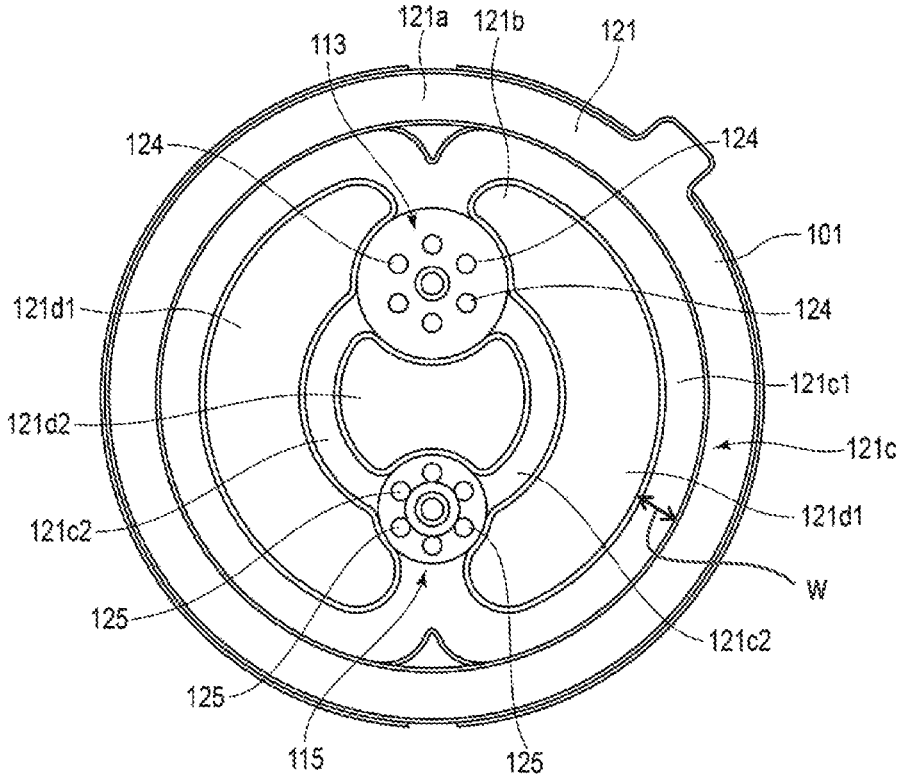
FIG. 2 is a plan view of a configuration of a pump main body of the piezoelectric pump according to the embodiment.
Figure 3:
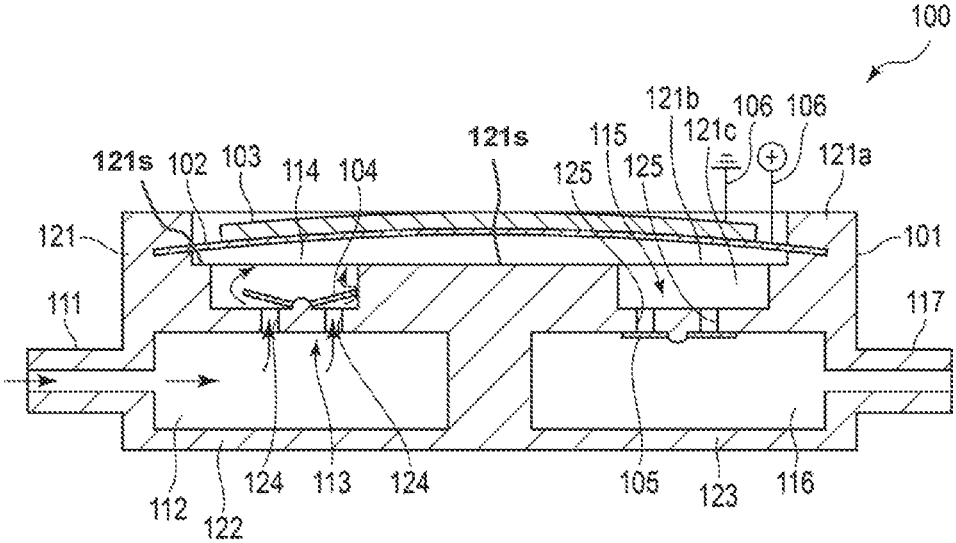
FIG. 3 is a cross-sectional view of a diaphragm and a piezoelectric element, which are used in the piezoelectric pump according to the embodiment, illustrating an example of a bending displacement.
Figure 4:
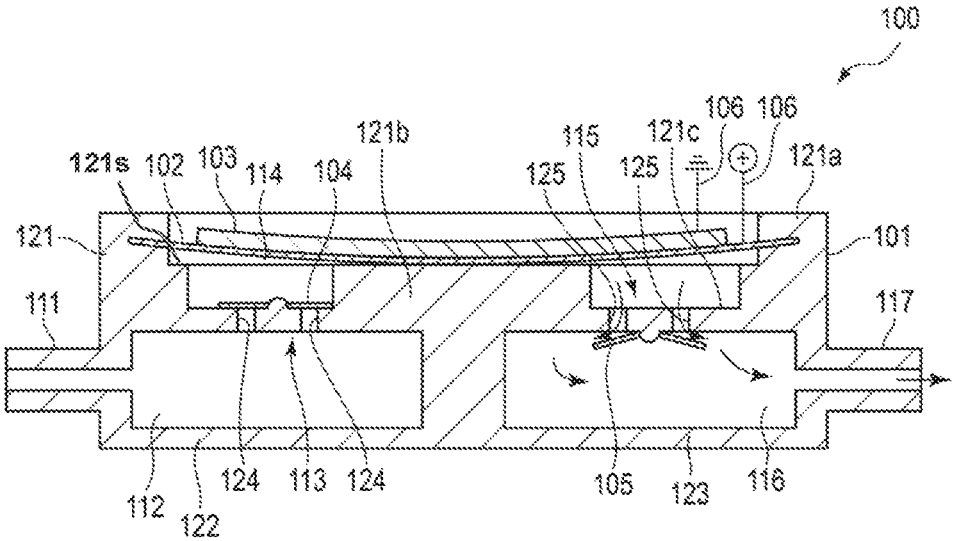
FIG. 4 is a cross-sectional view of the diaphragm and the piezoelectric element, which are used in the piezoelectric pump according to the embodiment, illustrating an example of a bending displacement.
Figure 5:
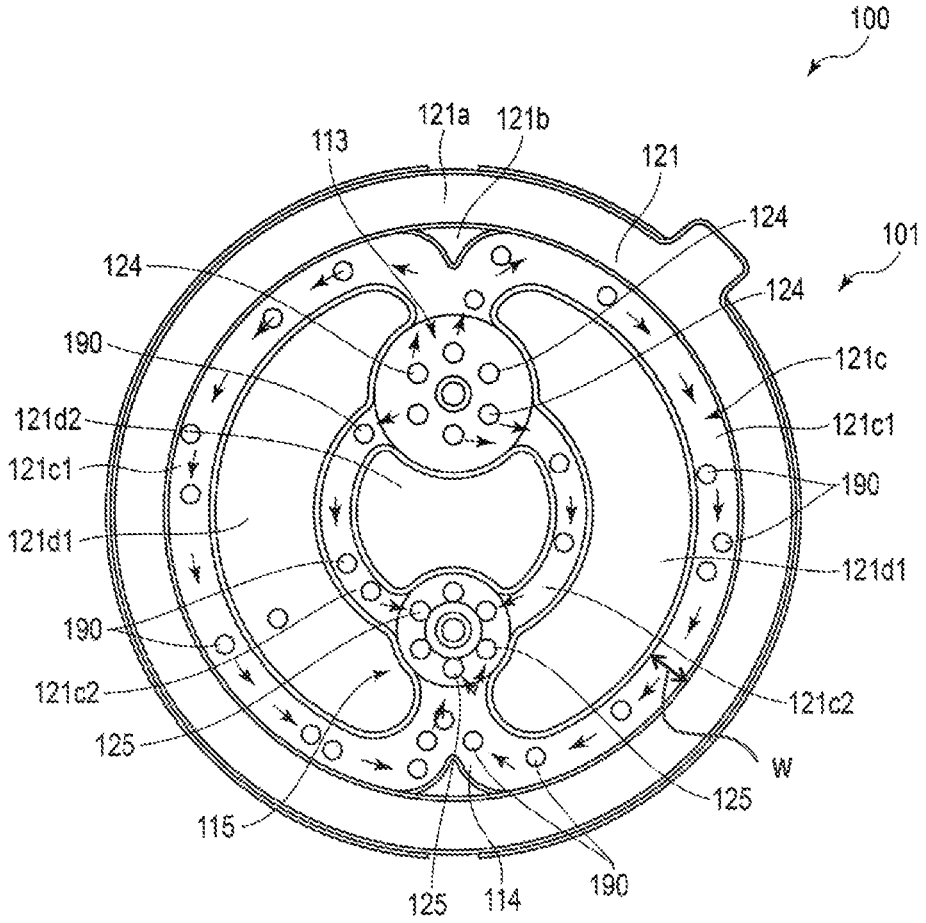
FIG. 5 is a diagram illustrating an example of the flow of liquid within a pressure chamber of the piezoelectric pump according to the embodiment.
Figure 6:
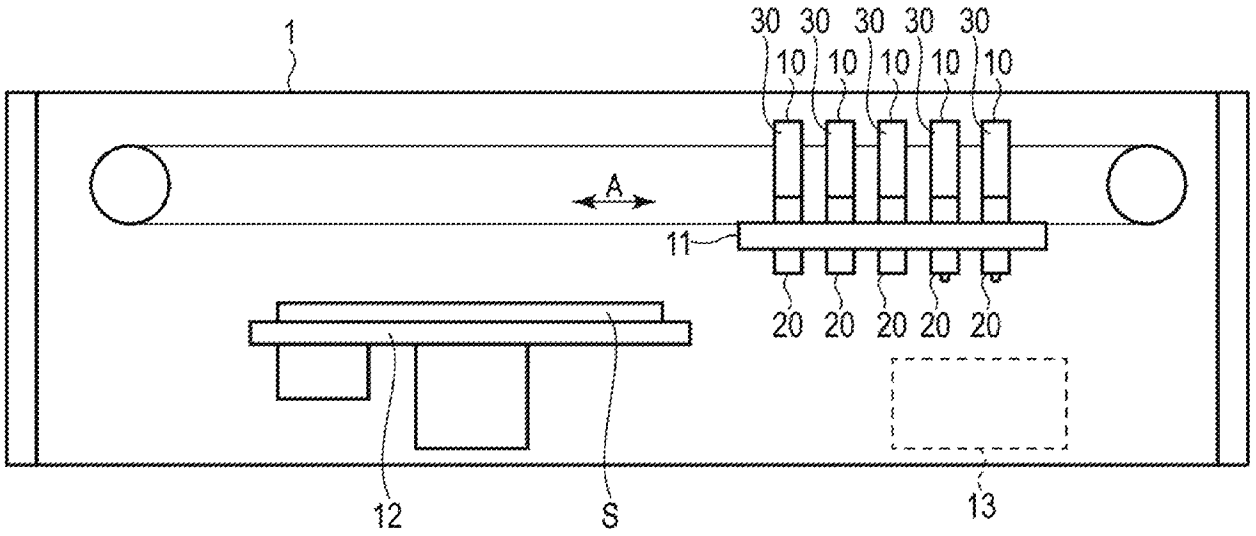
FIG. 6 is a side view of a configuration of a recording apparatus according to the embodiment.
Figure 7:
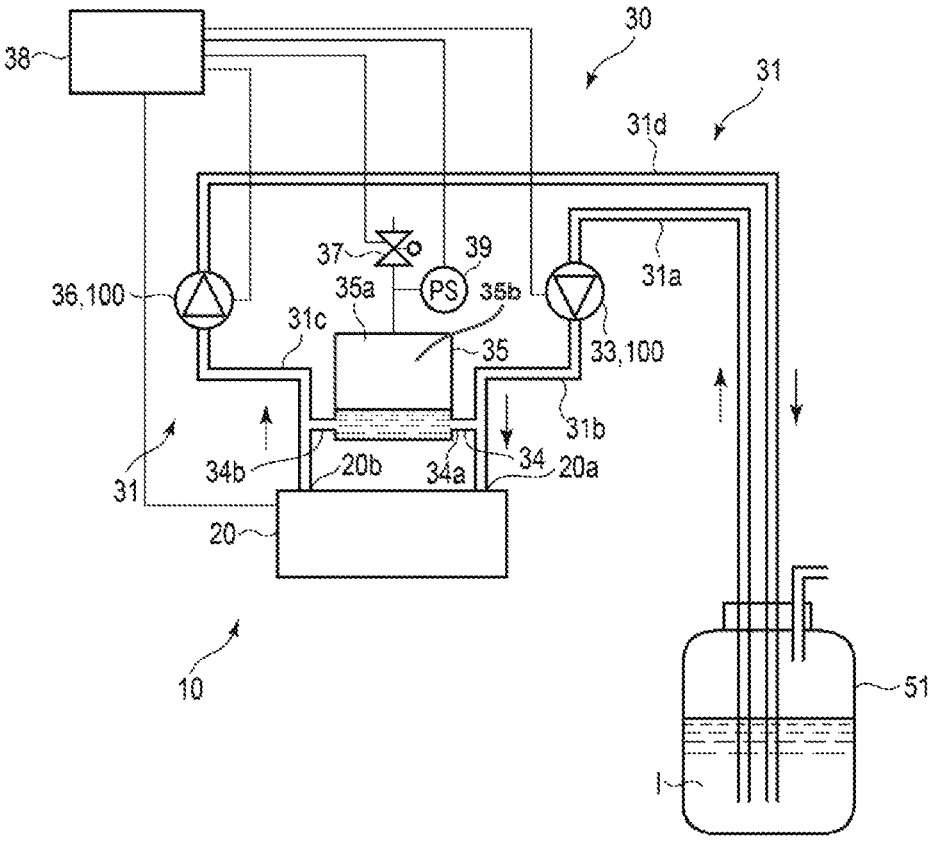
FIG. 7 is a diagram illustrating a configuration of a liquid ejection device used in the recording apparatus according to the embodiment.
Figure 8:
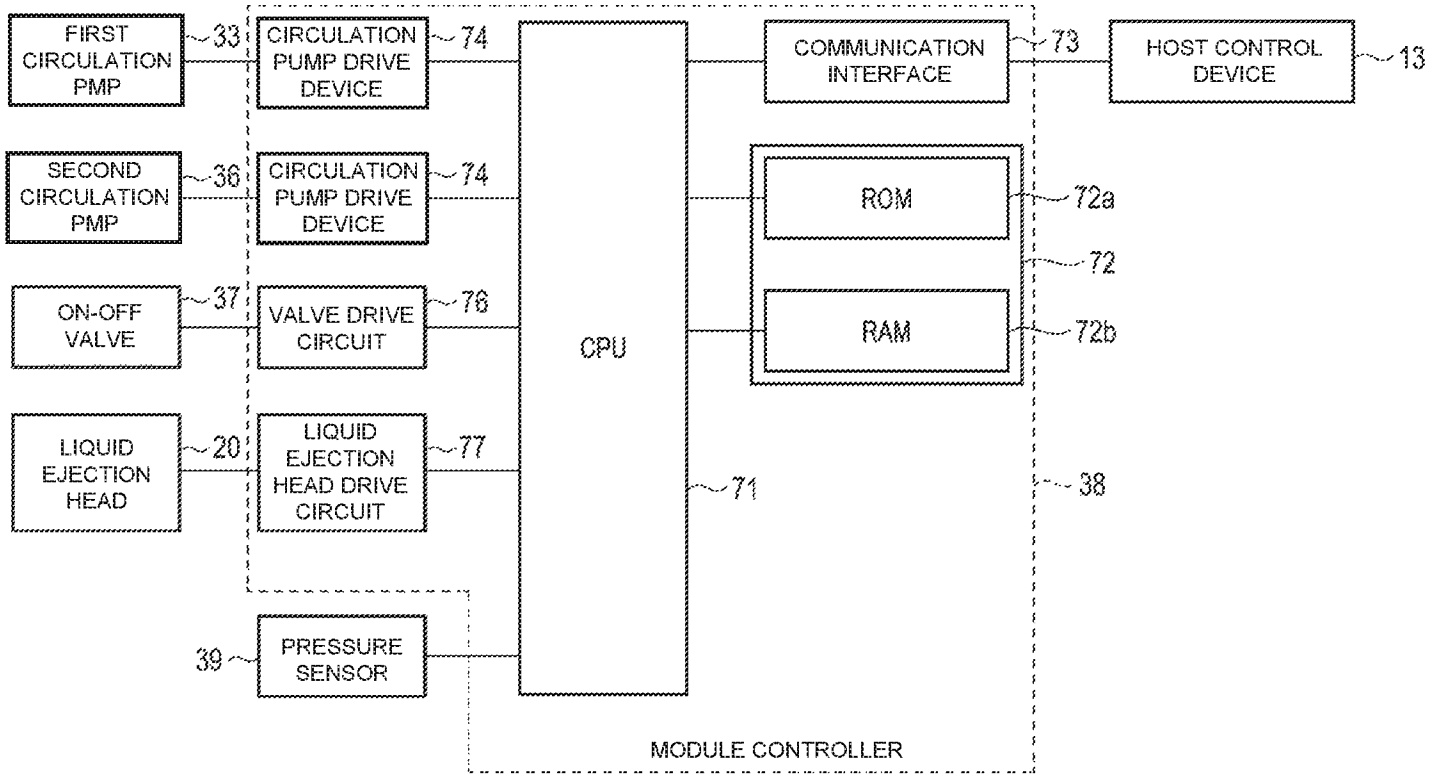
FIG. 8 is a diagram illustrating a configuration of a module controller used in the recording apparatus according to the embodiment.

Hereinafter, a piezoelectric pump 100, a liquid ejection device 10, and a recording apparatus 1 using the liquid ejection device 10 including the piezoelectric pump 100 according to an embodiment will be described with reference to FIGS. 1 to 8. In the figures, the same reference symbol represents the same or a similar portion. FIG. 1 is a cross-sectional view of a configuration of the piezoelectric pump 100 according to the embodiment. FIG. 2 is a plan view of a configuration of a pump main body 101 used in the piezoelectric pump 100. FIG. 3 and FIG. 4 are each a cross-sectional view of a diaphragm 102 and a piezoelectric element 103 of the piezoelectric pump 100 illustrating an example of a bending displacement. FIG. 5 is a diagram illustrating an example of the flow of liquid within a pressure chamber 114 of the piezoelectric pump 100. FIG. 6 is a side view of a configuration of the recording apparatus 1. FIG. 7 is a diagram illustrating a configuration of the liquid ejection device 10 used in the recording apparatus 1. FIG. 8 is a block diagram illustrating a configuration of a module controller 38 used in the recording apparatus 1. For the purpose of illustration, the configuration is increased in size, reduced in size, or omitted in each figure as appropriate. Further, for explanatory convenience, FIGS. 2 and 5 omit the illustration of the diaphragm 102, the piezoelectric element 103, and a first check valve 104.

(Piezoelectric Pump 100)

First, the piezoelectric pump 100 according to the embodiment will be described with reference to FIGS. 1 to 5. The piezoelectric pump 100 is a so-called diaphragm pump. The piezoelectric pump 100 transports various types of liquid such as ink, pharmaceutical products, and analytical reagents. This embodiment is an example in which the piezoelectric pump 100 transports ink as liquid. Further, this embodiment is an example in which the piezoelectric pump 100 is mounted in a recording apparatus 1 including a plurality of liquid ejection devices 10.

As illustrated in FIG. 1, the piezoelectric pump 100 includes the pump main body 101, the diaphragm 102, the piezoelectric element 103, the first check valve 104, and a second check valve 105. Further, the piezoelectric pump 100 includes a first port 111, a first buffer chamber 112, an inlet 113, the pressure chamber 114, an outlet 115, a second buffer chamber 116, and a second port 117.

The first port 111 is connected to piping or the like that supplies liquid on a primary side of the piezoelectric pump 100. The first port 111 is connected to the first buffer chamber 112. For example, the first port 111 is formed of a part of the pump main body 101. For example, the first port 111 is formed in a cylinder connectable to the piping.

The first buffer chamber 112 is provided to a secondary side of the first port 111 and also to a primary side of the pressure chamber 114. The first buffer chamber 112 forms a space having a predetermined volume. The first buffer chamber 112 is formed by, for example, partially hollowing the pump main body 101.

The inlet 113 fluidly connects the first buffer chamber 112 and the pressure chamber 114 to each other. The inlet 113 is a hole for fluidly connecting the first buffer chamber 112 and the pressure chamber 114 of the pump main body 101 to each other. For example, the inlet 113 includes a plurality of first holes 124. The first check valve 104 is provided on the pressure chamber 114 side of the inlet 113.

The pressure chamber 114 is configured by the pump main body 101, the diaphragm 102, and the piezoelectric element 103. The pressure chamber 114 is formed to have a predetermined volume. Further, the volume of the pressure chamber 114 varies when the piezoelectric element 103 provided to the diaphragm 102 bends and when the diaphragm 102 deforms (see FIGS. 3 and 4).

As a specific example, the pressure chamber 114 is configured by a recess 121 having a bottomed cylindrical shape, which is formed in the pump main body 101, the diaphragm 102 provided on the opening end side of the recess 121, and the piezoelectric element 103 provided to an outer surface (surface on the opening end side) of the diaphragm 102. In other words, the pressure chamber 114 is formed of the recess 121 of the pump main body 101 and includes the diaphragm 102 provided to the opening end side of the recess 121 and the piezoelectric element 103 provided to the outer surface of the diaphragm 102. Further, the inlet 113 and the outlet 115 are provided to the bottom portion of the pressure chamber 114, that is, a bottom portion 121*b* of the recess 121 of the pump main body 101, the bottom portion 121*b* facing the diaphragm 102. The inlet 113 and the outlet 115 include the first check valve 104 and the second check valve 105, respectively. The first check valve 104 and the second check valve 105 regulate a direction of the flow of liquid in the pressure chamber 114. As a specific example, liquid flows in the pressure chamber 114 from the inlet 113. The liquid is then discharged from the outlet 115 to the outside of the pressure chamber 114.

Further, as illustrated in FIG. 2, the pressure chamber 114 includes a groove 121*c* at the outer circumferential edge and the center side of the bottom portion 121*b* of the recess 121, the bottom portion 121*b* facing the diaphragm 102. The groove 121*c* includes the inlet 113 and the outlet 115. Further, though not illustrated in FIG. 2, the inlet 113 includes the first check valve 104. As illustrated in FIG. 1, in the pressure chamber 114, a distance H1 from the diaphragm 102 at an initial position to a surface 121*s* of the bottom portion 121*b* on the diaphragm 102 side is set to be smaller than a depth H2 of the groove 121*c*. Note that the initial position of the diaphragm 102 is a position of the diaphragm 102 when a voltage is not supplied to the piezoelectric element 103.

As illustrated in FIG. 1, the outlet 115 fluidly connects the pressure chamber 114 and the second buffer chamber 116 to each other. The outlet 115 is a hole for fluidly connecting the pressure chamber 114 and the second buffer chamber 116 of the pump main body 101 to each other. For example, the outlet 115 includes a plurality of second holes 125. The second check valve 105 is provided on the second buffer chamber 116 side of the outlet 115.

As illustrated in FIG. 1, the second buffer chamber 116 is provided to a secondary side of the pressure chamber 114 and also to a primary side of the second port 117. The second buffer chamber 116 forms a space having a predetermined volume. The second buffer chamber 116 is formed by, for example, partially hollowing the pump main body 101.

As illustrated in FIG. 1, the second port 117 is connected to piping or the like provided on a secondary side of the piezoelectric pump 100. The second port 117 is connected to the second buffer chamber 116. For example, the second port 117 is formed of a part of the pump main body 101. For example, the second port 117 is formed in a cylinder connectable to the piping.

In other words, the pump main body 101 includes the first port 111, the first buffer chamber 112, the inlet 113, a part of the pressure chamber 114, the outlet 115, the second buffer chamber 116, and the second port 117.

As illustrated in FIGS. 1 and 2, the pump main body 101 is formed in, for example, a cylindrical shape. The pump main body 101 is formed by, for example, integrating a plurality of members.

The pump main body 101 includes the recess 121 having a bottomed cylindrical shape, for example, at one end in an axis direction X illustrated in FIG. 1. The pump main body 101 includes the first port 111 and the second port 117 each having a cylindrical shape, for example, on an outer circumferential surface of the pump main body 101 on the other end side in the axis direction X. The pump main body 101 includes, for example, a first hollow portion 122 and a second hollow portion 123. The first hollow portion 122 is fluidly connected to the first port 111. The second hollow portion 123 is fluidly connected to the second port 117. Further, the pump main body 101 includes, for example, the plurality of first holes 124 and the plurality of second holes 125. The plurality of first holes 124 connect the recess 121 and the first hollow portion 122 to each other. The plurality of second holes 125 connect the recess 121 and the second hollow portion 123 to each other. The first hollow portion 122 forms the first buffer chamber 112. The second hollow portion 123 forms the second buffer chamber 116.

As illustrated in FIG. 1, the recess 121 includes a wall portion 121*a* having a cylindrical shape and the bottom portion 121*b* continuous with the wall portion 121*a*. The bottom portion 121*b* includes the plurality of first holes 124 and the plurality of second holes 125. The diaphragm 102 is provided to the wall portion 121*a*. The bottom portion 121*b* includes, for example, the groove 121*c*.

As illustrated in FIG. 1, the groove 121*c* is recessed from the surface 121*s* of the bottom portion 121*b*, which faces the diaphragm 102, in the axis direction X of the pump main body 101. The groove 121*c* is provided in, for example, a region of the bottom portion 121*b*, in which the plurality of first holes 124 and the plurality of second holes 125 are disposed. In other words, the plurality of first holes 124 and the plurality of second holes 125 are formed in the bottom surface of the groove 121*c* provided in the bottom portion 121*b*.

As illustrated in FIG. 2, the groove 121*c* includes, for example, a first groove 121*c*1 and a second groove 121*c*2. The first groove 121*c*1 is provided on the outer circumferential edge side of the bottom portion 121*b*. The second groove 121*c*2 is provided on the center side of the bottom portion 121*b*.

For example, as illustrated in FIG. 2, the first groove 121*c*1 is formed at the outer circumferential edge adjacent to the wall portion 121*a* of the bottom portion 121*b*. The first groove 121*c*1 fluidly connects the plurality of first holes 124 and the plurality of second holes 125 to each other on the outer circumferential edge side of the bottom portion 121*b*.

For example, as illustrated in FIG. 2, the second groove 121*c*2 fluidly connects the plurality of first holes 124 and the plurality of second holes 125 to each other on the center side of the bottom portion 121*b*. For example, the second groove 121*c*2 is provided so as to avoid a region between the plurality of first holes 124 and the plurality of second holes 125 in a direction orthogonal to an axis direction of the recess 121. Note that the axis direction of the recess 121 is the same direction as the axis direction X of the pump main body 101.

As a specific example, as illustrated in FIG. 2, the groove 121*c* of the pressure chamber 114 includes a pair of first grooves 121*c*1, which are each curved in an arc shape having a predetermined radius of curvature along the inner circumferential surface of the wall portion 121*a*, and a pair of second grooves 121*c*2, which are each curved in an arc shape having a radius of curvature smaller than the radius of curvature of the first grooves 121*c*1. In other words, the bottom portion 121*b* of the recess 121 includes a pair of first stage portions 121*d*1 each having an arc shape, and a second stage portion 121*d*2 having a curved outer circumferential surface, so as to form the groove 121*c*. Each of the first stage portions 121*d*1 is formed between the first groove 121*c*1 and the second groove 121*c*2. The second stage portion 121*d*2 is formed between the paired second grooves 121*c*2 and also between the plurality of first holes 124 and the plurality of second holes 125. In such a manner, the groove 121*c* forms a plurality of flow paths, which connect the inlet 113 and the outlet 115 to each other over the entire region of the bottom portion 121*b*.

As illustrated in FIG. 1, in the recess 121, the distance H1 is set to be smaller than a depth H2. As described above, the distance H1 is a distance from a surface of the diaphragm 102 at the initial position, which faces the bottom portion 121*b*, to a surface of the bottom portion 121*b*, which faces the diaphragm 102. As described above, the depth H2 is a distance from the surface of the bottom portion 121*b*, which faces the diaphragm 102, to a surface of the groove 121*c*, which faces the diaphragm 102. The depth H2 is the depth of the groove 121*c*.

For example, the distance H1 from the surface of the diaphragm 102, which faces the bottom portion 121*b*, to the surface of the bottom portion 121*b*, which faces the diaphragm 102, is set to 100 μm. Further, for example, the depth H2 from the surface of the bottom portion 121*b*, which faces the diaphragm 102, to the surface of the groove 121*c*, which faces the diaphragm 102, is set to 400 μm. Further, for example, a width W of the groove 121*c* is set to be larger than the distance H1 from the surface of the diaphragm 102, which faces the bottom portion 121*b*, to the surface of the bottom portion 121*b*, which faces the diaphragm 102. Here, the width W of the groove 121*c* is a width in a direction orthogonal to an axis direction X of the recess 121 and is also a width in a direction orthogonal to a direction in which the groove 121*c* extends.

The plurality of first holes 124 form the inlet 113. The plurality of second holes 125 form the outlet 115. For example, the plurality of first holes 124 and the plurality of second holes 125 are provided at symmetric positions of the bottom portion 121*b*.

The diaphragm 102 is, for example, a disc-like metal plate. For example, the diaphragm 102 is made of stainless material. For example, in order to avoid direct contact with liquid, the diaphragm 102 includes a coating layer made of resin material on the surface on the pressure chamber 114 side. The diaphragm 102 is connected to, for example, a device that supplies an alternating-current (AC) voltage via wiring 106. Such a voltage supply device is, for example, a circulation pump drive circuit 74 of the module controller 38 of the recording apparatus 1. The module controller 38 will be described later. Note that the material forming the diaphragm 102 is not limited to the stainless material, and the material may be, for example, a material such as nickel, brass, gold, silver, or copper.

The piezoelectric element 103 is piezoelectric ceramics. The piezoelectric element 103 is formed of, for example, lead zirconate titanate (PZT). The piezoelectric element 103 is, for example, a circular plate having an outer diameter, which is smaller than the outer diameter of the diaphragm 102 and the inner diameter of the wall portion 121*a* of the recess 121. The piezoelectric element 103 is connected to, for example, the circulation pump drive circuit 74 of the module controller 38 via the wiring 106.

As illustrated in FIG. 1, the piezoelectric element 103 is fixed to the outer surface of the diaphragm 102, that is, a surface of the diaphragm 102, which is opposite to the surface on the pressure chamber 114 side, with an adhesive agent or the like. The piezoelectric element 103 is polarized in a thickness direction, and expands and contracts in a surface direction when an electric field is applied in the thickness direction.

The piezoelectric element 103 constitutes an actuator together with the diaphragm 102. When an AC voltage is applied to the piezoelectric element 103 in the thickness direction, the electric field is thus applied to the piezoelectric element 103 in the thickness direction, and the piezoelectric element 103 expands and contracts in the surface direction. The diaphragm 102 deforms by deformation (expansion and contraction) of the piezoelectric element 103 to increase or decrease the volume of the pressure chamber 114. Note that the material forming the piezoelectric element 103 is not limited to PZT, and other materials may be used.

As illustrated in FIG. 1, the first check valve 104 is provided to the groove 121*c* of the recess 121 to cover the inlet 113. The first check valve 104 prevents the liquid from flowing backward from the pressure chamber 114 to the first buffer chamber 112. The first check valve 104 is made of material resistant to liquid. In this embodiment, the first check valve 104 is made of, for example, polyimide material.

This is because the polyimide material is resistant to various ink materials such as water-based ink, oil-based ink, volatile solvent ink, and ultraviolet (UV) ink, which are liquid to be ejected in the recording apparatus 1. Note that the first check valve 104 may also be made of, in place of polyimide, various materials including resins or metals highly resistant to ink, such as polyethylene terephthalate (PET), ultrahigh molecular weight polyethylene (PE), polypropylene (PP), polyphenylene sulfide (PPS), polyether ether ketone (PEEK), perfluoro alkoxy alkane (PFA), perfluoro ethylene propylene copolymer (FEP), ethylene-tetrafluoroethylene (ETFE), polytetrafluoroethylene (PTFE), aluminum, stainless, and nickel. Note that any material resistant to liquid can be set for the first check valve 104 as appropriate.

As illustrated in FIG. 1, the second check valve 105 is provided within the second buffer chamber 116 to cover the outlet 115. The second check valve 105 prevents the liquid from flowing backward from the second buffer chamber 116 to the pressure chamber 114. The second check valve 105 is made of the same material as the material of the first check valve 104.

Next, an operation example of the piezoelectric pump 100 thus configured will be described with reference to FIGS. 3 to 5.

As illustrated in FIGS. 3 and 4, the wiring 106 is connected to the diaphragm 102 and the piezoelectric element 103. First, an AC voltage with a predetermined waveform is applied to the diaphragm 102 and the piezoelectric element 103 via the wiring 106. By application of the voltage, as illustrated in FIG. 3, the piezoelectric element 103 bends to move away from the bottom portion 121*b* of the recess 121. When the piezoelectric element 103 bends, the diaphragm 102 also bends to move away from the bottom portion 121*b* of the recess 121. This increases the volume of the pressure chamber 114. As the volume of the pressure chamber 114 increases, the pressure chamber 114 is depressurized. Thus, the pressure within the first buffer chamber 112 becomes higher than the pressure within the pressure chamber 114, and the first check valve 104 opens. Therefore, as indicated by the arrows in FIG. 3, the liquid within the first buffer chamber 112 moves to the pressure chamber 114 through the inlet 113.

Next, a voltage opposite to the voltage applied in the state illustrated in FIG. 3 is applied to the piezoelectric element 103. By application of the voltage, as illustrated in FIG. 4, the piezoelectric element 103 bends to come close to the bottom portion 121*b* of the recess 121. When the piezoelectric element 103 bends, the diaphragm 102 also bends to come close to the bottom portion 121*b* of the recess 121. This decreases the volume of the pressure chamber 114. As the volume of the pressure chamber 114 decreases, the pressure chamber 114 is pressurized. Thus, the pressure within the pressure chamber 114 becomes higher than the pressure within the second buffer chamber 116, and the second check valve 105 opens. Further, at that time, the pressure within the pressure chamber 114 becomes higher than the pressure within the first buffer chamber 112, and the first check valve 104 closes. Therefore, as indicated by the arrows in FIG. 4, the liquid within the pressure chamber 114 moves to the second buffer chamber 116 through the outlet 115.

If the AC voltage is continuously applied to the piezoelectric element 103, the piezoelectric element 103 repeats a bending displacement to move away from the bottom portion 121*b*, which is illustrated in FIG. 3, and a bending displacement to come close to the bottom portion 121*b*, which is illustrated in FIG. 4. Therefore, the liquid flows from the first port 111 to the second port 117 through the first buffer chamber 112, the inlet 113, the pressure chamber 114, the outlet 115, and the second buffer chamber 116, to be supplied to the secondary side of the piezoelectric pump 100. Note that the AC voltage to be applied to the piezoelectric element 103 is, for example, an AC voltage with a rectangular waveform of 100 Hz at 100 V.

Further, in the pressure chamber 114, part of the liquid moved from the inlet 113 to the pressure chamber 114 flows along the pair of first grooves 121*c*1 and the pair of second grooves 121*c*2 as indicated by the arrows in FIG. 5. The remaining liquid flows to the outlet 115 through a gap between the bottom portion 121*b* in the pressure chamber 114 and the diaphragm 102.

At that time, the distance H1 from the surface of the diaphragm 102, which faces the bottom portion 121*b*, to the surface of the bottom portion 121*b*, which faces the diaphragm 102, is set to be smaller than the depth H2 (the depth of the groove 121*c*) from the surface of the bottom portion 121*b*, which faces the diaphragm 102, to the surface of the groove 121*c*, which faces the diaphragm 102. Therefore, since a flow path friction of the groove 121*c* is smaller than another flow path friction within the pressure chamber 114, the liquid moved from the inlet 113 to the pressure chamber 114 moves to the outlet 115 through the groove 121*c*. Thus, as illustrated in FIG. 5, air bubbles 190 included in the liquid are discharged from the outlet 115 through the groove 121*c*. Therefore, the air bubbles 190 can be prevented from being accumulated within the pressure chamber 114.

As described above, the piezoelectric pump 100 includes the groove 121*c* in the bottom portion 121*b* of the pressure chamber 114. The depth H2 of the groove 121*c* is set to be larger than the distance H1 between the diaphragm 102 and the bottom portion 121*b* of the pressure chamber 114. Therefore, in the flow path friction within the pressure chamber 114 from the inlet 113 to the outlet 115, the flow path friction in the groove 121*c* is smaller than the flow path friction between the diaphragm 102 and the bottom portion 121*b*.

Accordingly, the liquid moved from the inlet 113 and the air bubbles 190 included in the liquid move through the groove 121*c* within the pressure chamber 114 and then move from the outlet 115 to the secondary side. In other words, in the flow volume of the liquid passing from the inlet 113 to the outlet 115 through the pressure chamber 114, the proportion of the flow volume of the liquid passing through the groove 121*c* within the pressure chamber 114 is large. Thus, the air bubbles 190 included in the liquid pass through the groove 121*c* and are then discharged from the outlet 115. This can prevent the air bubbles from being accumulated within the pressure chamber 114. Further, the air bubbles pre-existing within pressure chamber 114 are also discharged from the outlet 115 after passing through the groove 121*c*.

More specifically, the groove 121*c* includes the pair of first grooves 121*c*1 and the pair of second grooves 121*c*2. As described above, the first groove 121*c*1 is a groove provided on the outer circumferential edge side of the bottom portion 121*b*. In other words, the first groove 121*c*1 is a groove provided along the inner circumferential surface of the wall portion 121*a* of the pressure chamber 114. As described above, the second groove 121*c*2 is a groove provided on the center side of the bottom portion 121*b*. In other words, the second groove 121*c*2 is a groove provided close to the center of the bottom portion 121*b* in the pressure chamber 114. Further, the depth H2 of the groove 121*c* is set to be larger than the distance H1 between the diaphragm 102 and the surface 121*s* of the bottom portion 121*b* in the pressure chamber 114. With this configuration, the groove 121*c* is disposed over the entire region of the bottom portion 121*b* of the recess 121, and a cross-sectional area of the flow path of the groove 121*c* can be ensured. The cross-sectional area of the flow path is a cross-sectional area orthogonal to a direction in which the liquid flows. Therefore, it is possible to help the liquid between the diaphragm 102 and the surface 121*s* of the bottom portion 121*b* move to the outlet 115 via the groove 121*c* and to set the flow volume in the groove 121*c* to a suitable flow volume.

Thus, for example, the pair of first grooves 121*c*1 allows the air bubbles 190 existing on the outer side in a radial direction of the pressure chamber 114 to be guided to the outlet 115. Further, the pair of second grooves 121*c*2 allows the air bubbles 190 existing close to the center of the pressure chamber 114 to be guided to the outlet 115. Therefore, the air bubbles 190 can be prevented from being accumulated within the pressure chamber 114.

In such a manner, the piezoelectric pump 100 can prevent the air bubbles 190 from hindering the pressurization and depressurization within the pressure chamber 114 when the diaphragm 102 bends. Thus, the piezoelectric pump 100 can suppress a reduction in flow volume of the liquid to be ejected from the outlet 115 and can eject a desired amount of liquid.

As described above, the piezoelectric pump 100 according to this embodiment allows the air bubbles within the pressure chamber 114 to be suitably discharged.

(Liquid Ejection Device 10 and Recording Apparatus 1)

Next, a liquid ejection device 10 including the piezoelectric pump 100 and a recording apparatus 1 including such a liquid ejection devices 10 will be described with reference to FIGS. 6 to 8.

As illustrated in FIGS. 6 to 8, the recording apparatus 1 includes a plurality of liquid ejection devices 10, a head support mechanism 11, a medium support mechanism 12, and a host control device 13. The head support mechanism 11 supports the liquid ejection devices 10 so as to be movable. The medium support mechanism 12 supports a recording medium S so as to be movable.

As illustrated in FIG. 6, the plurality of liquid ejection devices 10 are disposed in parallel in a predetermined direction A and supported by the head support mechanism 11. Each liquid ejection device 10 incorporates a liquid ejection head 20 and a circulation device 30. Each liquid ejection device 10 ejects liquid, e.g., ink I, from the liquid ejection head 20 to form a desired image on a recording medium S. The recording medium S is disposed to face the liquid ejection device 10.

The liquid ejection devices 10 eject respective colors, e.g., cyan ink, magenta ink, yellow ink, black ink, and white ink, but the color or characteristics of the ink I to be used are not limited. The liquid ejection device 10 can eject transparent and glossy ink, special ink whose color comes out when irradiated with infrared rays or ultraviolet rays, or other ink, in place of white ink, for example. The plurality of liquid ejection devices 10 have the same configuration but use different types of ink I, for example.

The liquid ejection head 20 is, for example, an inkjet head. As illustrated in FIG. 7, the liquid ejection head 20 includes a supply port 20*a*, in which the ink I flows, and a recovery port 20*b*, from which the ink I flows out. The liquid ejection head 20 includes, for example, a nozzle plate including a plurality of nozzle holes, a base plate, and a manifold joined to the base plate. The base plate includes a plurality of ink pressure chambers. Additionally, the base plate includes predetermined inkflow paths between the plurality of ink pressure chambers and the nozzle plate.

Next, the circulation device 30 will be described. The circulation device 30 is, for example, integrally coupled to the upper portion of the liquid ejection head 20 by metal coupling parts.

As illustrated in FIG. 7, the liquid ejection device 10 includes the circulation device 30. The circulation device 30 includes a predetermined circulation path 31, a first circulation pump 33, a bypass flow path 34, a buffer tank 35, a second circulation pump 36, and an on-off valve 37. The circulation path 31 can cause the liquid to circulate through the liquid ejection head 20. Further, the circulation device 30 includes the module controller 38 illustrated in FIG. 8. The module controller 38 controls an operation of ejecting liquid, as will be described later.

Further, as illustrated in FIG. 7, the circulation device 30 of the liquid ejection device 10 includes a cartridge 51. The cartridge 51 is an ink replenishing tank (liquid tank) provided to the outside of the circulation path 31.

The cartridge 51 (liquid tank) can retain the ink I, and the inner space of the cartridge 51 is opened to the atmosphere (released to the atmosphere).

As illustrated in FIG. 7, the circulation path 31 includes a first flow path 31*a*, a second flow path 31*b*, a third flow path 31*c*, and a fourth flow path 31*d*. The first flow path 31*a* connects the cartridge 51 and the first circulation pump 33 to each other. The second flow path 31*b* connects the first circulation pump 33 and the supply port 20*a* of the liquid ejection head 20 to each other. The third flow path 31*c* connects the recovery port 20*b* of the liquid ejection head 20 and the second circulation pump 36 to each other. The fourth flow path 31*d* connects the second circulation pump 36 and the cartridge 51 (liquid tank) to each other. The first flow path 31*a* and the fourth flow path 31*d* each include a pipe made of metal or resin material and a tube covering the outer surface of the pipe. The tube covering the outer surface of the pipe of each of the first flow path 31*a* and the fourth flow path 31*d* is, for example, a PTFE tube.

As illustrated in FIG. 7, the ink I that circulates through the circulation path 31 passes, from the cartridge 51, through the first flow path 31*a*, the first circulation pump 33, the second flow path 31*b*, and the supply port 20*a* of the liquid ejection head 20, to reach the liquid ejection head 20. Further, the ink I that circulates through the circulation path 31 passes, from the liquid ejection head 20, through the recovery port 20*b* of the liquid ejection head 20, the third flow path 31*c*, the second circulation pump 36, and the fourth flow path 31*d*, to reach the cartridge 51.

The first circulation pump 33 is the piezoelectric pump 100. As illustrated in FIG. 7, in the first circulation pump 33, the first port 111 is connected to the first flow path 31*a*, and the second port 117 is connected to the second flow path 31*b*. The first circulation pump 33 pumps out the liquid from the first flow path 31*a* toward the second flow path 31*b*. In other words, the first circulation pump 33 repeats pressurization and depressurization within the pressure chamber 114 by the operation of the piezoelectric element 103 and soaks up the ink I from the cartridge 51 to supply the ink I to the liquid ejection head 20.

As illustrated in FIG. 7, the bypass flow path 34 is a flow path that connects the second flow path 31*b* and the third flow path 31*c* to each other. The bypass flow path 34 simplistically connects the supply port 20*a*, which is the primary side of the liquid ejection head 20 in the circulation path 31, and the recovery port 20*b*, which is the secondary side of the liquid ejection head 20 in the circulation path 31, without passing through the liquid ejection head 20.

The buffer tank 35 is connected to the bypass flow path 34. Specifically, the bypass flow path 34 includes a first bypass flow path 34*a* and a second bypass flow path 34*b*. The first bypass flow path 34*a* connects a predetermined lower portion of one of a pair of side walls of the buffer tank 35 and the second flow path 31*b* to each other. The second bypass flow path 34*b* connects a predetermined lower portion of the other one of the pair of side walls of the buffer tank 35 and the third flow path 31*c* to each other.

For example, the first bypass flow path 34*a* and the second bypass flow path 34*b* have the same length and diameter and each have the diameter smaller than a diameter of the circulation path 31. For example, the diameter of the circulation path 31 is set to approximately twice to five times the diameter of each of the first bypass flow path 34*a* and the second bypass flow path 34*b*. For example, in the first bypass flow path 34*a* and the second bypass flow path 34*b*, a distance between a position at which the second flow path 31*b* and the first bypass flow path 34*a* are connected to each other and the supply port 20*a* of the liquid ejection head 20 is set to be equal to a distance between a position at which the third flow path 31*c* and the second bypass flow path 34*b* are connected to each other and the recovery port 20*b* of the liquid ejection head 20.

A cross-sectional area of the flow path of the buffer tank 35 is larger than the cross-sectional area of the bypass flow path 34. The buffer tank 35 is formed to be capable of storing liquid. The buffer tank 35 is a rectangular box-like tank including, for example, an upper wall, a lower wall, a rear wall, a front wall, and the pair of right and left side walls, and forms a housing chamber 35*a* in which liquid is stored.

The position at which the first bypass flow path 34*a* and the buffer tank 35 are connected to each other and the position at which the second bypass flow path 34*b* and the buffer tank 35 are connected to each other are set at the same height. Within the buffer tank 35, the lower region of the housing chamber 35*a* contains the ink I flowing in the bypass flow path 34, and the upper region of the housing chamber 35*a* forms an air chamber 35*b*. In other words, the buffer tank 35 is capable of storing a predetermined amount of liquid and air. Further, the buffer tank 35 includes the on-off valve 37 and a pressure sensor 39. The on-off valve 37 can cause the air chamber 35*b* of the buffer tank 35 to be opened to the atmosphere.

The second circulation pump 36 is the piezoelectric pump 100. As illustrated in FIG. 7, in the second circulation pump 36, the first port 111 is connected to the third flow path 31*c*, and the second port 117 is connected to the fourth flow path 31*d*. The second circulation pump 36 pumps out the liquid from the third flow path 31*c* toward the fourth flow path 31*d*. In other words, the second circulation pump 36 is a depressurization pump that recovers the ink I from the liquid ejection head 20 and replenishes the recovered ink I to the cartridge 51.

The on-off valve 37 illustrated in FIG. 7 is a normally-closed solenoid on-off valve, for example. The normally-closed solenoid on-off valve is opened when the power is turned on, and is closed when the power is turned off. The on-off valve 37 is opened and closed by the control of the module controller 38 and can thus open and close the air chamber 35*b* of the buffer tank 35 with respect to the atmosphere.

The pressure sensor 39 illustrated in FIG. 7 detects a pressure of the air chamber 35*b* of the buffer tank 35 and sends pressure data, which indicates the value of the pressure, to the module controller 38. When the on-off valve 37 is opened and when the air chamber 35*b* of the buffer tank 35 is opened to the atmosphere, the pressure data detected by the pressure sensor 39 has a value equal to the value of an atmospheric pressure. The pressure sensor 39 detects a pressure of the air chamber 35*b* of the buffer tank 35 when the on-off valve 37 is closed and when the air chamber 35*b* of the buffer tank 35 is not opened to the atmosphere.

The pressure sensor 39 outputs the pressure of the air chamber 35*b* as an electrical signal by using, for example, a semiconductor piezoresistive pressure sensor. The semiconductor piezoresistive pressure sensor includes a diaphragm and a semiconductor strain gauge. The diaphragm receives an external pressure. The semiconductor strain gauge is formed on a surface of the diaphragm. The semiconductor piezoresistive pressure sensor converts a change in electrical resistance into an electrical signal and detects a pressure, the change in electrical resistance being due to the piezoresistive effect produced in the strain gauge along with deformation of the diaphragm by the external pressure.

As illustrated in FIG. 8, the module controller 38 controls the operation of the liquid ejection head 20, the first circulation pump 33, the second circulation pump 36, and the on-off valve 37. The module controller 38 includes a processor 71, a memory 72, a communication interface 73, circulation pump drive circuits 74, a valve drive circuit 76, and a liquid ejection head drive circuit 77.

The processor 71 is an arithmetic element to execute arithmetic processing, for example, a central processing unit (CPU) 71. The CPU 71 performs various types of processing on the basis of data such as programs stored in the memory 72. The CPU 71 executes programs stored in the memory 72 to function as a control circuit capable of executing various types of control.

The memory 72 is storage to store various types of information. The memory 72 includes, for example, a read only memory (ROM) 72*a* and a random access memory (RAM) 72*b*.

The ROM 72*a* is a non-volatile read-only memory. The ROM 72*a* stores programs, data to be used in the programs, and the like. For example, the ROM 72*a* stores, as control data to be used for pressure control, a calculation formula for calculating an ink pressure of a nozzle hole, a target pressure range, and various set values such as maximum adjustment values of the respective pumps.

The RAM 72*b* is a volatile memory, which functions as a working memory. The RAM 72*b* temporarily stores data being processed by the CPU 71, or the like. Further, the RAM 72*b* temporarily stores programs to be executed by the CPU 71.

The communication interface 73 is an interface for communicating with another device. The communication interface 73 relays, for example, communication with the host control device 13, which sends print data to the liquid ejection device 10.

The circulation pump drive circuit 74 applies an AC voltage to the piezoelectric element 103 of the piezoelectric pump 100 under the control of the CPU 71 to drive the piezoelectric pump 100. Accordingly, the circulation pump drive circuit 74 causes the ink I to circulate within the circulation path 31. The circulation pump drive circuits 74 are provided in the same number as the number of first circulation pump 33 and second circulation pump 36 and are respectively connected to the first circulation pump 33 and the second circulation pump 36. The circulation pump drive circuit 74 connected to the first circulation pump 33 applies a drive voltage to the piezoelectric element 103 of the first circulation pump 33. The circulation pump drive circuit 74 connected to the second circulation pump 36 applies a drive voltage to the piezoelectric element 103 of the second circulation pump 36.

The valve drive circuit 76 drives the on-off valve 37 under the control of the CPU 71 and causes the air chamber 35*b* of the buffer tank 35 to be opened to the atmosphere.

The liquid ejection head drive circuit 77 drives the liquid ejection head 20 by applying a voltage to the actuator of the liquid ejection head 20 under the control of the CPU 71. Accordingly, the liquid ejection head drive circuit 77 causes the ink I to be ejected from the nozzle hole of the liquid ejection head 20.

In the configuration described above, the CPU 71 communicates with the host control device 13 through the communication interface 73 to receive various types of information such as operation conditions. Further, various types of information acquired by the CPU 71 are sent to the host control device 13 of the recording apparatus 1 through the communication interface 73.

Further, the CPU 71 acquires a detection result from the pressure sensor 39 and controls the operation of the circulation pump drive circuits 74 and the valve drive circuit 76 on the basis of the acquired detection result. For example, the CPU 71 controls the circulation pump drive circuits 74 on the basis of the detection result of the pressure sensor 39. Accordingly, the CPU 71 controls the liquid pump-out capability of the first circulation pump 33 and the second circulation pump 36. Accordingly, the CPU 71 adjusts the ink pressure of the nozzle hole.

Further, the CPU 71 controls the valve drive circuit 76 to open and close the on-off valve 37. Accordingly, the CPU 71 adjusts the liquid level of the buffer tank 35.

Further, the CPU 71 acquires the detection result from the pressure sensor 39. The CPU 71 controls the liquid ejection head drive circuit 77 on the basis of the acquired detection result. Accordingly, the CPU 71 causes ink droplets to be ejected on a recording medium from the nozzle hole of the liquid ejection head 20. Specifically, the CPU 71 inputs an image signal, which corresponds to image data, to the liquid ejection head drive circuit 77. The liquid ejection head drive circuit drives the actuator of the liquid ejection head 20 corresponding to the image signal. When the liquid ejection head drive circuit 77 drives the actuator of the liquid ejection head 20, the actuator deforms. Accordingly, an ink pressure (nozzle surface pressure) of a nozzle hole located to face the actuator changes. The nozzle surface pressure is a pressure given by the ink I of the pressure chamber 114 to the meniscus formed by the ink I in the nozzle hole. When the nozzle surface pressure exceeds a predetermined value, which is defined by the shape of the nozzle hole, the characteristics of the ink I, and the like, the ink I is ejected from the nozzle hole. Accordingly, the CPU 71 causes an image, which corresponds to the image data, to be formed on a recording medium S.

As described above, the recording apparatus 1 uses the piezoelectric pumps 100 as the first circulation pump 33 and the second circulation pump 36 of the circulation device 30 of the liquid ejection device 10. With this configuration, the cartridge 51 is set to be opened to the atmosphere. Therefore, even if the ink I circulating within the circulation path 31 contains the air bubbles 190, the air bubbles 190 are discharged from the first circulation pump 33 and the second circulation pump 36. Thus, the first circulation pump 33 and the second circulation pump 36 can prevent the flow volume of the ink I, which is supplied to the secondary side, from being reduced. Therefore, the recording apparatus 1 can supply the ink I with a predetermined flow volume to the liquid ejection head 20 and stably control the ink pressure.

As described above, the recording apparatus 1 uses the piezoelectric pumps 100 as the first circulation pump 33 and the second circulation pump 36 and can thus suitably discharge air bubbles within the pressure chamber 114. Therefore, the recording apparatus 1 can stably control the ink pressure of the liquid ejection head 20.

Note that this embodiment is not limited to the example described above and can be embodied while modifying constituent elements without departing from the gist of this embodiment.

Figure 9:
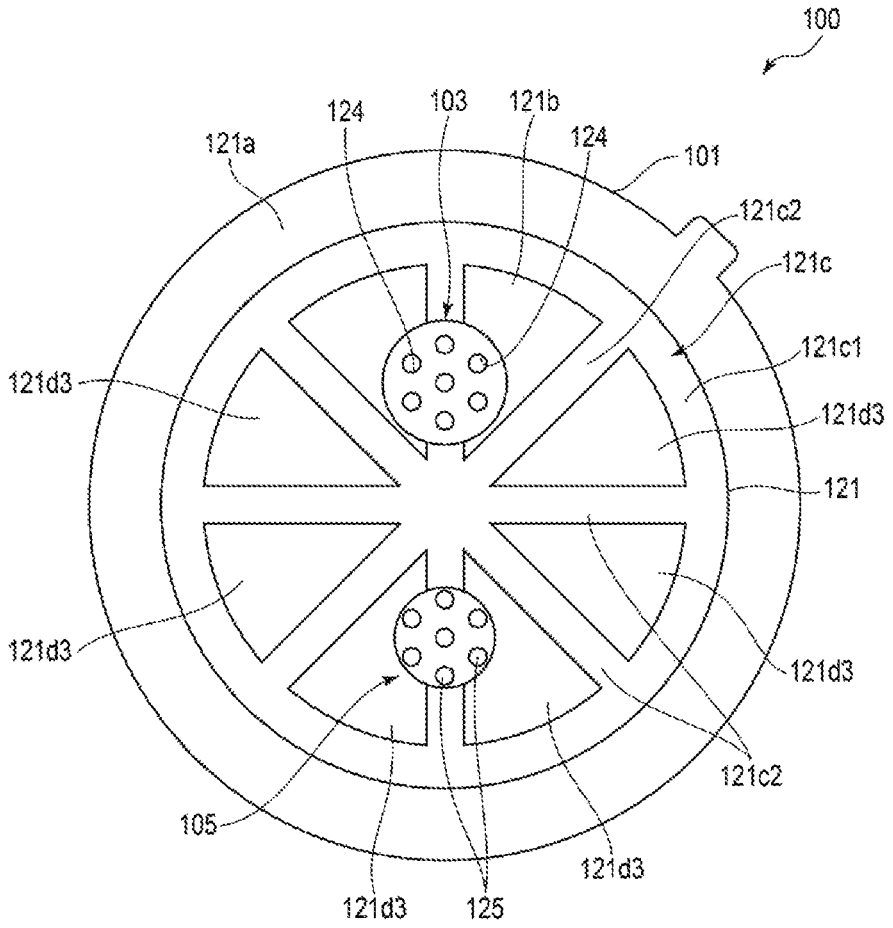
FIG. 9 is a plan view of a configuration of a pump main body of a piezoelectric pump according to another embodiment.

For example, in the example described above, the groove 121*c* of the bottom portion 121*b*, which is provided to the pressure chamber 114 of the pump main body 101, includes the pair of second grooves 121*c*2 each having an arc shape curved at a predetermined radius of curvature, but this embodiment is not limited to such an example. FIG. 9 is a plan view of a configuration of a pump main body 101 of a piezoelectric pump 100 according to another embodiment. As illustrated in FIG. 9, a groove 121*c* of the pump main body 101 of the piezoelectric pump 100 includes a plurality of second grooves 121*c*2 radially extending from the center of a bottom portion 121*b* in a pressure chamber 114 toward a first groove 121*c*1. If the groove 121*c* is formed as described above, the bottom portion 121*b* excluding the groove 121*c* is formed of a plurality of third stage portions 121*d*3 each having a fan-like shape in plan view.

Further, while the above example has described that the piezoelectric pump 100 is used in the recording apparatus 1 that ejects the ink I, but this embodiment is not limited to the example. For example, the piezoelectric pump 100 may be used in a liquid ejection device 10 that ejects liquid other than the ink I. Specifically, the piezoelectric pump 100 can be used in a device that ejects liquid containing conductive particles for forming a wiring pattern of a printed wiring board, for example. Further, the piezoelectric pump 100 can also be used for, for example, 3D printers, industrial production machines, and medical applications.

Further, in the example described above, the recording apparatus 1 includes, as the circulation device 30, the buffer tank 35 including the housing chamber 35*a*, in the bypass flow path 34, and in order to adjust the liquid level of the buffer tank 35, the on-off valve 37 is opened and closed, but this embodiment is not limited to the example. For example, the recording apparatus 1 does not necessarily include the buffer tank 35 and the on-off valve 37. Further, the recording apparatus 1 may include, for example, a filter and a trap for collecting the air bubbles 190 on the secondary side of the first circulation pump 33 of the circulation device 30.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A piezoelectric pump, comprising:

a pressure chamber having an inlet and an outlet;

a diaphragm that deforms to vary the volume of the pressure chamber to cause a liquid to flow in from the inlet and out from the outlet;

a groove in a bottom portion of the pressure chamber, the inlet and the outlet of the pressure chamber being in a bottom portion of the groove;

a first check valve at the inlet to regulate the flow of the liquid through the inlet; and a second check valve at the outlet to regulate the flow of the liquid through the outlet, wherein the groove comprises:

a pair of first groove portions in a central portion of the bottom of the pressure chamber, the pair of first groove portions individually extending in a curved shape from the inlet to the outlet, and a pair of second groove portions in an outer portion of the bottom of the pressure chamber at a position between the central portion and an outer edge of the bottom of the pressure chamber, the pair of second groove portions individually extending in a curved shape from the inlet to the outlet, and the bottom of the pressure chamber has a first stage portion between one of the pair of first groove portions and one of the pair of second groove portions and a second stage portion between the pair of first groove portions.

2. The piezoelectric pump according to claim 1, wherein the diaphragm faces the bottom of the pressure chamber.

3. The piezoelectric pump according to claim 1, wherein the groove has a depth greater than a distance between the diaphragm and an upper surface of the bottom portion of the pressure chamber.

4. The piezoelectric pump according to claim 1, further comprising:

a first buffer chamber provided on a primary side of the inlet; and a second buffer chamber provided on a secondary side of the outlet.

5. The piezoelectric pump according to claim 1, wherein, when the diaphragm deforms in a direction toward the bottom of the pressure chamber, the diaphragm contacts the second stage portion.

6. The piezoelectric pump according to claim 1, wherein the pair of first groove portions are symmetric about a line connecting a center position of the inlet and a center position of the outlet.

7. The piezoelectric pump according to claim 1, wherein the pair of first groove portions are each arc-shaped within a plane parallel to an upper surface of the second stage portion.

8. The piezoelectric pump according to claim 7, wherein the pair of second groove portions each comprise an arc shape within the plane parallel to the upper surface of the second stage portion.

9. The piezoelectric pump according to claim 1, wherein the pair of second groove portions each comprise an arc shape within a plane parallel to an upper surface of the second stage portion.

10. The piezoelectric pump according to claim 1, wherein the pair of first groove portions connect to the inlet at different positions from each other, and the pair of second groove portions connect to the inlet at the same position as each other.

11. A liquid ejection device, comprising:

a liquid tank;

a liquid ejection head having a primary side connected to the liquid tank and a secondary side also connected to of the liquid tank;

a piezoelectric pump on one of the primary side or the secondary side of the liquid ejection head; and a circulation path that connects the liquid tank, the liquid ejection head, and the piezoelectric pump to one another, wherein the piezoelectric pump includes:

a pressure chamber having an inlet and an outlet, a diaphragm that deforms to vary the volume of the pressure chamber to cause a liquid to flow in from the inlet and out from the outlet, a groove in a bottom of the pressure chamber, the inlet and the outlet of the pressure chamber being in a bottom portion of the groove, a first check valve at the inlet to regulate the flow of the liquid through the inlet, and a second check valve at the outlet to regulate the flow of the liquid through the outlet, and the groove comprises:

a pair of first groove portions in a central portion of the bottom of the pressure chamber, the pair of first groove portions individually extending in a curved shape from the inlet to the outlet, and a pair of second groove portions in an outer portion of the bottom of the pressure chamber at a position between the central portion and an outer edge of the bottom of the pressure chamber, the pair of second groove portions individually extending in a curved shape from the inlet to the outlet, and the bottom of the pressure chamber has a first stage portion between one of the pair of first groove portions and one of the pair of second groove portions and a second stage portion between the pair of first groove portions.

12. The liquid ejection device according to claim 11, wherein the diaphragm faces the bottom of the pressure chamber.

13. The liquid ejection device according to claim 11, wherein the groove has a depth greater than a distance between the diaphragm and an upper surface of the bottom of the pressure chamber.

14. The liquid ejection device according to claim 11, further comprising:

a first buffer chamber provided on a primary side of the inlet; and a second buffer chamber provided on a secondary side of the outlet.

15. The liquid ejection device according to claim 11, wherein, when the diaphragm deforms in a direction toward the bottom of the pressure chamber, the diaphragm contacts the second stage portion.

16. The liquid ejection device according to claim 11, wherein the pair of first groove portions are symmetric about a line connecting a center position of the inlet and a center position of the outlet.

17. The liquid ejection device according to claim 11, wherein the pair of first groove portions are each arc-shaped within a plane parallel to an upper surface of the second stage portion.

18. The liquid ejection device according to claim 17, wherein the pair of second groove portions each comprise an arc shape within the plane parallel to the upper surface of the second stage portion.

19. The liquid ejection device according to claim 11, wherein the pair of second groove portions each comprise an arc shape within a plane parallel to an upper surface of the second stage portion.

20. The liquid ejection device according to claim 11, wherein the pair of first groove portions connect to the inlet at different positions from each other, and the pair of second groove portions connect to the inlet at the same position as each other.

* * * * *